United States Patent [19]

Hoshi

[11] Patent Number: 4,707,633

[45] Date of Patent: Nov. 17, 1987

[54] SHADOW MASK FOR ENHANCED RESOLUTION AND BRIGHTNESS IN COLOR CATHODE RAY TUBES

[75] Inventor: Toshiharu Hoshi, Shizuoka, Japan

[73] Assignee: Nippon Gakki Seizo Kabushiki Kaisha' , Japan

[21] Appl. No.: 797,697

[22] Filed: Nov. 13, 1985

[30] Foreign Application Priority Data

Nov. 14, 1984 [JP] Japan ..... 59-240243

[51] Int. Cl.[4] ..... H01J 29/07

[52] U.S. Cl. ..... 313/402; 313/153

[58] Field of Search ..... 313/402, 403, 408, 153, 313/154, 156; 335/284, 210, 212

[56] References Cited

U.S. PATENT DOCUMENTS 4,513,272 4/1985 Verweel et al. ..... 313/403 X

OTHER PUBLICATIONS

*Steel Material Handbook,* 1967, pp. 828–831 (Japanese edition).

*Metals Handbook*–8th ed.; vol. 1, "Properties & Selection of Metals", Novelty, Ohio: American Society for Metals, p. 816.

*Metals Handbook,* 9th ed., vol. 3, "Properties & Selection: Stainless Steels, Tool Materials and Special Purpose Material"s, Metals Park, Ohio: American Society for Metals, p. 792.

*Primary Examiner*—David K. Moore

*Assistant Examiner*—K. Wieder

*Attorney, Agent, or Firm*—Ostrolenk, Faber, Gerb & Soffen

[57] ABSTRACT

In construction of a shadow mask for color picture tubes, use of Invar for the shadow mask suppresses thermal deformation caused by electron beam impingement and provision of a four pole magnet frame surrounding each mask aperture causes increased convergence of electron beams, thereby enabling production of images with high resolution and brightness.

7 Claims, 2 Drawing Figures

SHADOW MASK FOR ENHANCED RESOLUTION AND BRIGHTNESS IN COLOR CATHODE RAY TUBES

The present invention relates to a shadow mask for colour cathode ray tubes, and more particularly relates to an improvement in resolution and brightness of a shadow mask for colour cathode ray tubes in which magnetic field is formed in each mask aperture for passage of electron beams.

For example in U.S. Pat. No. 4,135,111, it is proposed to form magnetic field in each mask aperture for passage of electron beams in order to increase convergence of the electron beams and raise pass rate of the electron beams through a shadow mask for production of images with high brightness. For better formation of such magnetic field, the shadow mask of this type is conventionally made of magnetic material such as Cu-Ni-Co alloys and Cu-Ni-Fi alloys. Despite the increase pass rate of electron beams, 50 to 60% of them still impinge on the shadow mask and inevitably cause rise in temperature of the shadow mask. Since the above-described magnetic materials used for the shadow mask are rather high in thermal expansion, heating by electron beam impingement is apt to cause thermal deformation of the shadow mask. Such deformation causes a shift in position between the mask apertures and an associated luminescent screen of the picture tube, thereby developing doming which mars colour purity of images.

It is an object of the present invention to provide a shadow mask productive of images with high resolution and brightness on a screen of a colour cathode ray tube.

In accordance with a basic aspect of the present invention, a shadow mask is made of Invar of low thermal expansion and each mask aperture is surrounded by a magnet frame.

Suppressed thermal deformation of the shadow mask by use of Invar is well combined with intense convergence of electron beams by use of the magnet frame.

Figure 1:
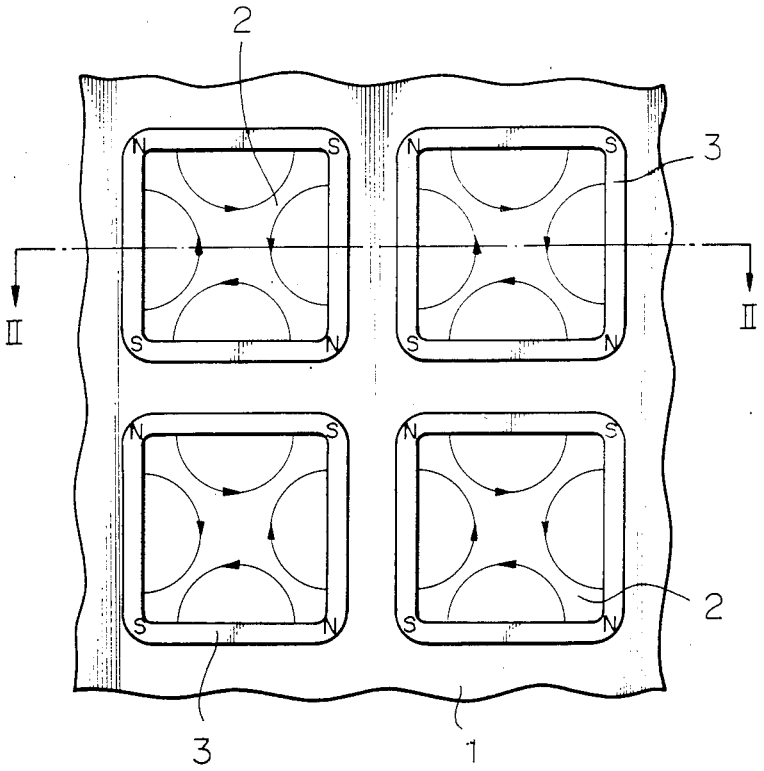
Figure 2:
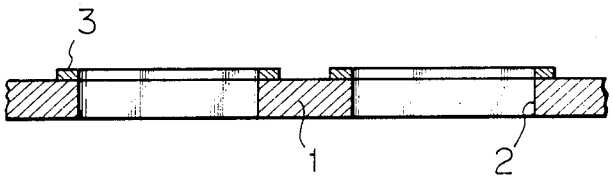

The invention will further be explained in more detail in reference to the embodiments shown in accompanying drawings, in which;

FIG. 1 is an enlarged front view of one embodiment of the shadow mask in accordance with the present invention, and FIG. 2 is a section taken along a line II—II in FIG. 1.

In FIGS. 1 and 2, a shadow mask 1 is provided with a number of mask apertures 2 arranged in regular matrix orientation. Each matrix aperture 2 is surrounded by a magnet frame 3.

The shadow mask 1 is made of Invar which is nickel-steel. For example, it contains 0.20 wt% or less of C, 0.5 wt% of Mn, 36 wt% of Ni and Fe in balance. Its thermal expansion is in general very low. For example, its rate of thermal expansion is 1 to $2\times10^{-6}$/°C. in the temperature range up to 40° C.

The magnet frame 3 is made of Fe-Cr-Co spinodal decomposition type alloy magnet, Cu-Ni-Fe alloy magnet, rare earth magnet or ferrite magnet.

In production of such a magnet frame 3 from rare earth magnet or ferrite magnet, powdery magnet is dispersed in resin solution and the dispersion is applied to the peripheries of the mask apertures 2. It may also be applied by way of vacuum evaporation and spattering after proper local masking of the shadow mask face. When produced from Fe-Cr-Co spinodal decomposition type alloy magnet or Cu-Ni-Fe alloy magnet, a foil of magnet is attached to the total face of the shadow mask and unnecessary sections are removed by etching.

The thickness of the shadow mask should preferably be in a range from 0.15 to 0.2 mm. When square mask apertures 2 are employed as in the illustrated example, the length of one side should preferably be in a range from 0.2 to 0.3 mm. In the matrix orientation, the distance between adjacent mask apertures should preferably be in a range from 0.4 to 0.8 mm. The width of the magnet frame 3 should preferably be in a range from 30 to 50 μm and its thickness in a range from 50 to 100 μm. Same magnetic poles are located at opposite corner of the square.

Use of Invar for the shadow mask effectively suppresses its thermal deformation caused by electron beam impingement. The four pole magnetic field formed by the magnet frame causes increased convergence of electron beams which reduces impingement itself. Both effects concur to produce images with high resolution and brightness.

The following examples are illustrative of the present invention but not to be construed as limiting the same.

Using shadow masks shown in Table 1, colour cathode ray tubes of 20 inch size were prepared and their rate of thermal deformation, rate of passage of electron beams and rate of doming were recorded. Table 2 shows the data obtained. Samples 1 to 3 belongs to prior art and samples 4 to 7 to the present invention.

TABLE 1

| Sample No | material for shadow mask | material for magnet frame | magnet frame size in mm. | mask aperture size in mm. | Formation of magnet frame |
|---|---|---|---|---|---|
| 1 | pure soft steel | — | — | 0.2 | — |
| 2 | Invar | — | — | " | — |
| 3 | 12Co—28Cr—Fe | — | — | 0.28 | — |
| 4 | Invar | 12Co—28Cr—Fe | A 0.28<br>B 0.35<br>C 0.10 | " | Frame cut out by etching from sheet and bonded |
| 5 | " | 20Ni—20Fe—Cu | A 0.28<br>B 0.35<br>C 0.10 | " | Frame cut out by etching from sheet and bonded |
| 6 | " | $SmCo_5$ | A 0.28<br>B 0.35<br>C 0.05 | " | Powdery magnet coated with binder resin and fixed |
| 7 | " | Ba Ferrite | A 0.28<br>B 0.35 | " | Powdery magnet coated with binder resin |

TABLE 1-continued

| Sample No | material for shadow mask | material for magnet frame | magnet frame size in mm. | mask aperture size in mm. | Formation of magnet frame |
|---|---|---|---|---|---|
| | | | C 0.05 | | and fixed |

A; Inner size
B; Outer size
C; Thickness
Thickness of shadow masks; 0.2 mm
Pitch of mask apertures; 0.4 mm

TABLE 2

| Sample No. | Rate of deformation at 100 mm from image center (μm) | | Rate of electron beam passage (%) | | Rate of doming | |
|---|---|---|---|---|---|---|
| | 50° C. | 30° C. | 50° C. | 30° C. | 50° C. | 30° C. |
| 1 | 150 | 250 | 25 | 25 | small | large |
| 2 | 30 | 50 | 25 | 25 | small | large |
| 3 | 140 | 230 | 50 | 50 | small | large |
| 4 | 40 | 70 | 50 | 50 | small | small |
| 5 | 43 | 75 | 50 | 50 | small | small |
| 6 | 35 | 60 | 50 | 50 | small | small |
| 7 | 80 | 150 | 50 | 50 | small | small |

All data were taken near the periphery of the mask.
Temperature at mask center was 60° C.

Rate of deformation was larger for the samples of the present invention. This is believed to be caused by the larger rate of thermal expansion of the magnet frames than Invar.

The data in Table 2 well warrants the fact that application of the present invention assures high brightness with less colour slip.

I claim:

1. A shadow mask for color cathode ray tubes having mask apertures aligned in matrix orientation, wherein:

said shadow mask is made of a first material with a thermal expansion rate no greater than $2\times10^{-6}$/°C. for temperatures up to 40° C.;

each of said mask apertures is surrounded by a magnet frame comprising a second material that is magnetized; and the first and second materials are different from each other.

2. A shadow mask as claimed in claim 1, wherein:

each said mask aperture is square in shape; and said magnet has four poles arranged alternately at the four corners of the square.

3. A shadow mask as claimed in claim 1, wherein:

said first material comprises an alloy including nickel and iron and said magnet frame is made of magnet material selected from a group consisting of Fe-Cr-Co spinodal decomposition type alloy magnet, Cu-Ni-Fe alloy magnet, rare earth magnet and ferrite magnet.

4. A shadow mask as claimed in claim 1, wherein:

the thickness of said shadow mask is in a range from 0.15 to 0.2 mm.

5. A shadow mask as claimed in claim 1, wherein:

the width of said magnet frame is in a range from 30 to 50 μm.

6. A shadow mask as claimed in claim 1, wherein:

the thickness of said magnet frame is in a range from 50 to 100 μm.

7. A shadow mask as claimed in claim 1 wherein:

the distance between adjacent mask apertures is in a range from 0.2 to 0.3 mm.

* * * * *